US008365539B2

(12) United States Patent
Chen et al.

(10) Patent No.: US 8,365,539 B2
(45) Date of Patent: Feb. 5, 2013

(54) SYSTEM AND METHOD FOR THERMAL PROCESS INCLUDING A THERMOELECTRIC HEAT PUMP AND INTERNAL HEAT EXCHANGER

(75) Inventors: Gang Chen, Carlisle, MA (US); Christine Susanne Junior, Braunschweig (DE); Juergen Koehler, Sickte (DE)

(73) Assignee: Massachusetts Institute of Technology, Cambridge, MA (US)

( * ) Notice: Subject to any disclaimer, the term of this patent is extended or adjusted under 35 U.S.C. 154(b) by 276 days.

(21) Appl. No.: 12/658,709

(22) Filed: Feb. 12, 2010

(65) Prior Publication Data

US 2011/0197597 A1 Aug. 18, 2011

(51) Int. Cl.
*F25B 21/02* (2006.01)

(52) U.S. Cl. ..... 62/3.2; 62/3.3; 62/3.7; 62/513

(58) Field of Classification Search ..... 62/3.2, 62/3.3, 3.7, 513; 34/79, 86, 229; 165/139, 165/174

See application file for complete search history.

(56) References Cited

U.S. PATENT DOCUMENTS

| | | | | |
|---|---|---|---|---|
| 7,197,838 | B2 * | 4/2007 | Jo | 34/76 |
| 7,526,879 | B2 | 5/2009 | Bae et al. | |
| 2005/0199016 | A1 * | 9/2005 | Tadano et al. | 68/18 C |
| 2006/0266507 | A1 * | 11/2006 | Eom et al. | 165/166 |
| 2007/0101602 | A1 * | 5/2007 | Bae et al. | 34/77 |
| 2007/0145941 | A1 * | 6/2007 | Asada et al. | 318/811 |
| 2007/0169367 | A1 * | 7/2007 | Tadano | 34/77 |
| 2008/0060379 | A1 * | 3/2008 | Cheng | 62/616 |
| 2009/0019861 | A1 * | 1/2009 | Heckt et al. | 62/3.2 |
| 2009/0044576 | A1 * | 2/2009 | Moschutz | 68/5 C |
| 2009/0094990 | A1 * | 4/2009 | Nitschmann et al. | 62/3.3 |

(Continued)

FOREIGN PATENT DOCUMENTS

| | | |
|---|---|---|
| DE | 201 01 641 U1 | 7/2002 |
| DE | 10 2005 058285 | 6/2007 |

(Continued)

OTHER PUBLICATIONS

International Search Report and Written Opinion of PCT/US2011/024158 dated Aug. 9, 2011.

(Continued)

*Primary Examiner* — Mohammad Ali

(74) *Attorney, Agent, or Firm* — Hamilton, Brook, Smith & Reynolds, P.C.

(57) ABSTRACT

A system for using a thermal cycle for healing or cooling. The system comprises a thermoelectric module flowing a gas; and an internal heat exchanger flowing the gas and exchanging heat between the gas and another fluid; the gas flow from at least one of the thermoelectric module and the internal heat exchanger flowing for heating or cooling. The system may be for using a closed cycle to remove a liquid from at least one object comprising moisture, the system comprising an enclosure containing the at least one object and arranged to receive a hot and dry gas for flow over the at least one object and thereby to produce a flow of moist gas at an intermediate temperature. The internal heat exchanger is arranged to exchange heat between the flow of the moist gas at the intermediate temperature and a flow of cold dry gas, thereby producing cooled moist gas and pre-warmed dry gas.

22 Claims, 7 Drawing Sheets
(1 of 7 Drawing Sheet(s) Filed in Color)

U.S. PATENT DOCUMENTS

| | | | | |
|---|---|---|---|---|
| 2009/0165330 | A1* | 7/2009 | Krausch | 34/480 |
| 2009/0255142 | A1* | 10/2009 | Brown | 34/79 |
| 2009/0293301 | A1* | 12/2009 | Koch et al. | 34/467 |

FOREIGN PATENT DOCUMENTS

| | | |
|---|---|---|
| EP | 1 342 828 | 2/2003 |
| WO | WO 2007/068588 | 6/2007 |
| WO | WO 2007/071536 | 6/2007 |
| WO | WO 2007 077069 | 7/2007 |

OTHER PUBLICATIONS

International Preliminary Report on Patentability from PCT/US2011/024158 dated Aug. 14, 2012.

* cited by examiner

SYSTEM AND METHOD FOR THERMAL PROCESS INCLUDING A THERMOELECTRIC HEAT PUMP AND INTERNAL HEAT EXCHANGER

BACKGROUND OF THE INVENTION

Domestic tumble dryers that employ compression heat pumps consume 50% less primary energy than those equipped with electric resistance heaters. However, examinations of compression heat pumps from an ecological and safety-related standpoint raise questions about the refrigerants utilized in the process. To meet the growing concern about the high global warming potential of certain chemical compounds that are typically found in refrigerants, it is imperative to develop a substitute for compression heat pumps.

A conventional condensation tumble dryer includes a closed process air circuit, in which the enclosed air circulates inside the tumble dryer. Cool and dry process air is initially heated and then passed through the drum which spins wet clothes. During the subsequent vaporization process, moisture is removed from the load and the humid air eventually leaves the drum at a moderate temperature. Then, the humid air is cooled, the moisture is condensed and removed, and the air is heated up again, restarting the cycle. In a conventional heat pump, the heating and cooling takes places in the evaporator and condenser, respectively.

In addition to the use of electric resistance heaters and compression heat pumps, some designs using thermoelectric modules in tumble dryers have been proposed. However, there is an ongoing need for efficient alternatives to conventional heat pumps and electric resistance heaters in tumble dryers.

Further, there is an ongoing need for efficient techniques for heating and cooling in a wide variety of fields.

SUMMARY OF THE INVENTION

In accordance with an embodiment of the invention, there is provided a method for using a thermal cycle for heating or cooling. The method comprises flowing a gas through a thermoelectric module; flowing the gas through an internal heat exchanger in which the gas exchanges heat through the internal heat exchanger with another fluid; and flowing the gas for use in heating or cooling.

In a further, related embodiment there is provided a method for using a closed cycle to remove a liquid from at least one object comprising moisture. The method comprises flowing a hot and dry gas over the at least one object thereby producing moist gas at an intermediate temperature. The moist gas at the intermediate temperature is flowed through the internal heat exchanger, the moist gas at the intermediate temperature being in heat exchange relationship with cold dry gas flowing through the internal heat exchanger, thereby producing cooled moist gas. The cooled moist gas exiting the internal heat exchanger is flowed through a first heat exchanger that is in heat exchange relationship with a cold side of the thermoelectric module, thereby condensing the liquid in the moist gas and producing cold dry gas. The cold dry gas exiting the first heat exchanger is flowed through the internal heat exchanger in heat exchange relationship with the moist gas at the intermediate temperature, thereby pre-warming the cold dry gas. The pre-warmed dry gas is flowed through a second heat exchanger that is in heat exchange relationship with a hot side of the thermoelectric module, thereby closing the cycle by producing the hot dry gas that is flowed over the at least one object.

In further, related embodiments, flowing the hot and dry gas over the at least one object may comprise flowing the hot and dry gas into an enclosure containing the object. The gas may comprise air and the liquid may comprise water. The enclosure may comprise a drum of a tumble dryer. At least one of the first heat exchanger, second heat exchanger and internal heat exchanger may comprise a fin heat exchanger; or may be a shell and tube heat exchanger, a tube in tube heat exchanger, a twisted tube heat exchanger or a plate type heat exchanger. The thermoelectric module may comprise p- and n-doped semiconductor materials. The liquid may be removed from the object without use of a compression heat pump or electrical resistance heater. The internal heat exchanger may exchange heat in at least one of a cross flow, counter flow, or concurrent flow configuration. The first heat exchanger and second heat exchanger may be arranged in at least one of a cross flow, counter flow, or concurrent flow configuration. The first heat exchanger and second heat exchanger may be parts of a single heat exchanger that comprises the first heat exchanger and the second heat exchanger. The method may comprise heating or cooling at least one of: (i) at least a portion of a building, and (ii) a passenger compartment of a vehicle. The thermal cycle may be an open cycle. The other fluid may be the gas itself.

Corresponding systems are provided for using a thermal cycle for heating or cooling, and for using a closed cycle to remove a liquid from at least one object comprising moisture.

BRIEF DESCRIPTION OF THE DRAWINGS

The patent or application file contains at least one drawing executed in color. Copies of this patent or patent application publication with color drawings will be provided by the Office upon request and payment of the necessary fee.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

In accordance with an embodiment of the invention, there is provided a novel concept and design for using thermoelectric heat pumps in convection tumble dryers. Given their energy efficiency and the consequent reduced environmental impact, conventional heat pumps are now widely used in convection tumble dryers. However, the use of environmentally problematic refrigerants that are used in these heat pumps is gaining concern, and interest in alternative systems is increasing rapidly.

Thermoelectric heat pumps have witnessed significant efficiency increases in the recent past and therefore will be increasingly advantageous in this field of application. An embodiment according to the invention uses a thermoelectric heat pump and internal heat exchanger in a drying process that provides an efficient alternative to conventional systems, and that promises cost and energy savings as well as space and noise reduction.

Figure 1:
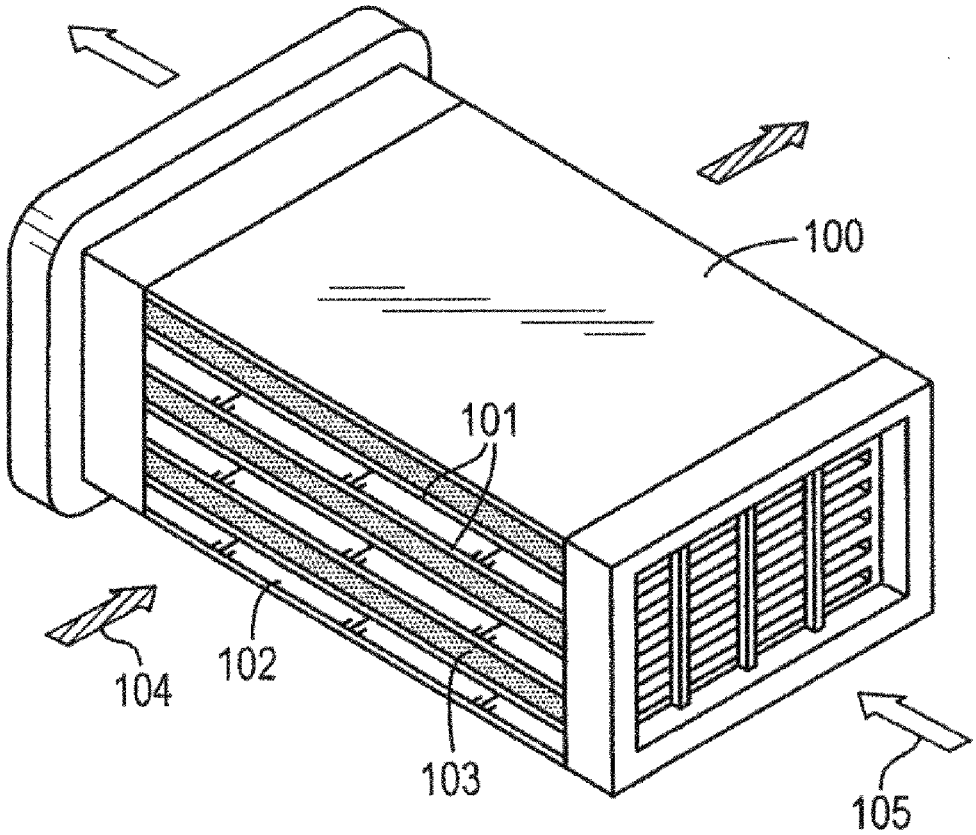
FIG. 1 is a diagram of a thermoelectric heat pump for use in a tumble dryer, in accordance with an embodiment of the invention.

FIG. 1 is a diagram of a thermoelectric heat pump for use in a tumble dryer, in accordance with an embodiment of the invention. In the embodiment of FIG. 1, a thermoelectric heat pump 100 includes one or more thermoelectric modules 101 that are sandwiched between fin heat exchangers 102 and 103. The thermoelectric modules 101 used in the system may consist of p- and n-doped semiconductor materials that are connected via copper junctions and develop a hot and cold side when an electric current is passed through them. In the module of FIG. 1, both the hot and cold sides of the thermoelectric modules 101 are in direct contact with the fin heat exchangers 102 and 103, which enables the heating and cooling of two fluid flows 104 and 105 passing through the heat exchanger. For example, fin heat exchanger 102 may be in contact with the cold side of the thermoelectric module 101 thereby cooling fluid flow 104, while fin heat exchanger 103 is in contact with the hot side of the thermoelectric module 101 thereby heating fluid flow 105. In FIG. 1, the fins that are present in areas 102 and 103 are not shown, with area 102 being shown in white and area 103 in shading, for contrast. Depending on the assembly of the components, the heating and cooling of the fluid flows 104 and 105 can be carried out in cross flow, counter flow, or concurrent flow configurations. It will be appreciated that other types of thermoelectric modules may be used than that of FIG. 1 (which is of a type shown in U.S. Pat. No. 7,526,879 B2 Bae et al.), for example using a variety of different possible semiconductor materials. It will further be appreciated that other types of heat exchangers may be used in thermoelectric module 101 than fin heat exchangers. For example, shell and tube, tube in tube, twisted tube and plate type heat exchangers may be used. Where the fluid flow is a gas such as air or humid air, fin heat exchangers are useful because of the large surface area available for heat exchange.

Figure 2:
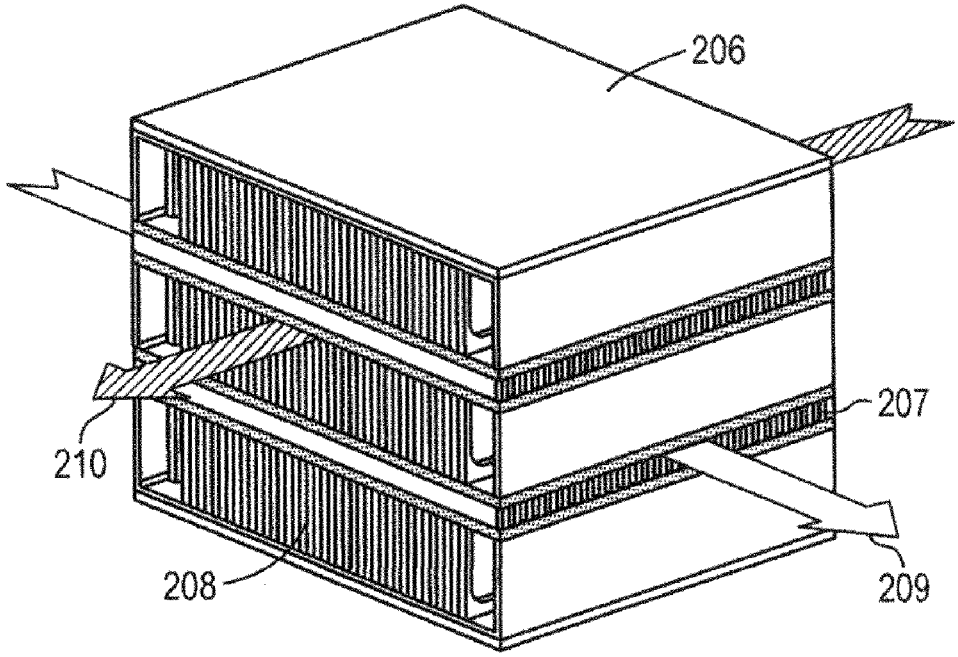
FIG. 2 is a diagram of an internal heat exchanger for use in a tumble dryer, in accordance with an embodiment of the invention.

FIG. 2 is a diagram of an internal heat exchanger for use in a tumble dryer, in accordance with an embodiment of the invention. In the embodiment of FIG. 2, the internal heat exchanger 206 includes two or more fin heat exchangers 207 and 208. The internal heat exchanger 206 is assembled such that it provides heat recovery by utilizing one fluid flow 209 to preheat the other fluid flow 210, and can be designed in a cross flow, counter flow, or concurrent flow heat exchanger configuration. In FIG. 2, the fins 208 through which fluid flow 210 is directed are shown in cross flow arrangement with the fins 207 through which flow 209 is directed. By an "internal" heat exchanger, it is intended that the heat exchanger exchanges heat between fluid flows that are internal to the drying process, as opposed to exchanging heat with the external surroundings of the system as is done, for example, with a condenser in a conventional heat pump system. For example, in FIG. 3 (discussed below), internal heat exchanger 306 exchanges heat between internal fluid flows 313 and 314. It will be appreciated that other types of heat exchangers than that of FIG. 2 (which is a fin heat exchanger of a type shown in G. Walker: Industrial Heat Exchangers: A Basic Guide. Hemisphere Publishing Corporation, New York, 1990), may be used in internal heat exchanger 206, such as shell and tube, tube in tube, twisted tube and plate type heat exchangers.

Figure 3:
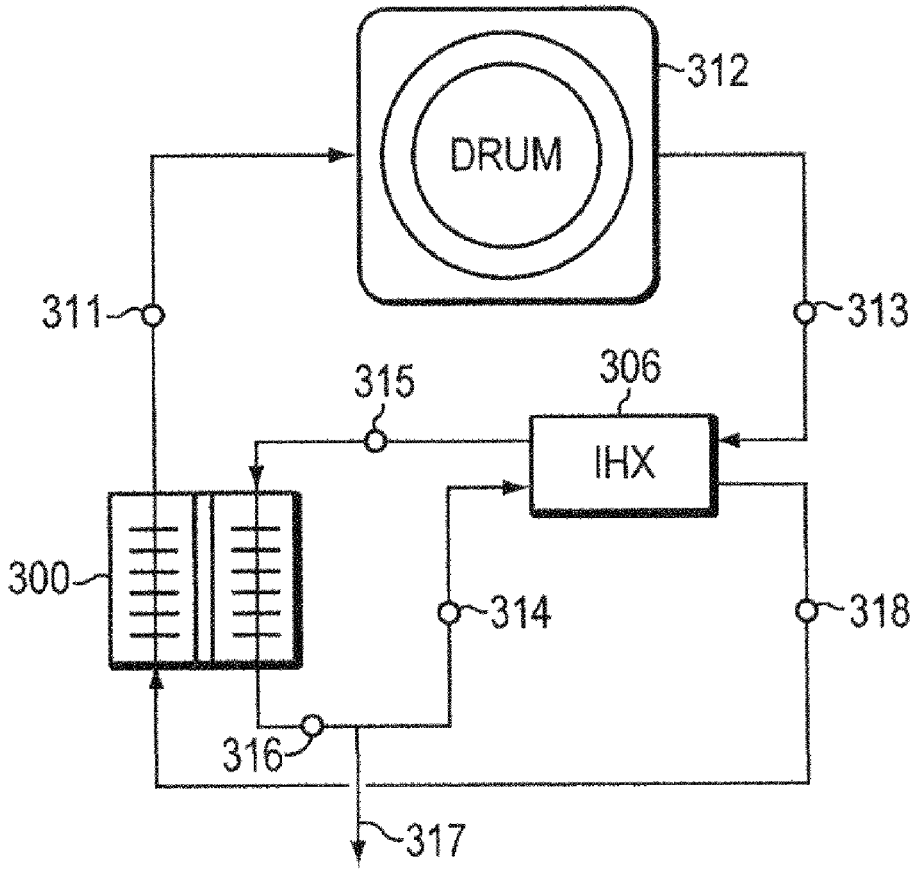
FIG. 3 is a schematic diagram of a drying process in a tumble dryer using a thermoelectric heat pump and internal heat exchanger, in accordance with an embodiment of the invention.

FIG. 3 is a schematic diagram of a drying process in a tumble dryer using a thermoelectric heat pump and internal heat exchanger, in accordance with an embodiment of the invention. In the drying process, hot and dry air 311 flows through the drum 312 of the tumble dryer, absorbs moisture, and exits the drum at an intermediate temperature at 313. In the internal heat exchanger 306, the energy of this air flow 313 is utilized to preheat the cold air flow 314 leaving the thermoelectric heat pump 300. After exiting the internal heat exchanger 306, air flow 315 enters the thermoelectric heat pump 300 and flows through the fin heat exchangers 102 connected to the cold sides of the thermoelectric modules 101 (see FIG. 1). This produces a cooler air flow 316 from which the included moisture condenses at drain 317. After the condensate has been removed, the cold and dry air at 314 is preheated in the internal heat exchanger 306 by utilizing energy from the air flow 313 exiting the drum 312. This preheated air 318 is lead to the thermoelectric heat pump 300 where it is heated by flowing through the fin heat exchangers 103 connected to the hot side of the thermoelectric modules 101 (see FIG. 1). The cycle then continues with hot and dry air 311 being directed to the drum 312 of the tumble dryer.

It will be appreciated that in accordance with an embodiment of the invention, there is no need to use an electrical resistance heater or compression heat pump in the drying process. The drying process may be without such components, and may use only a thermoelectric module and internal heat exchanger to perform the drying process instead.

Figure 4:
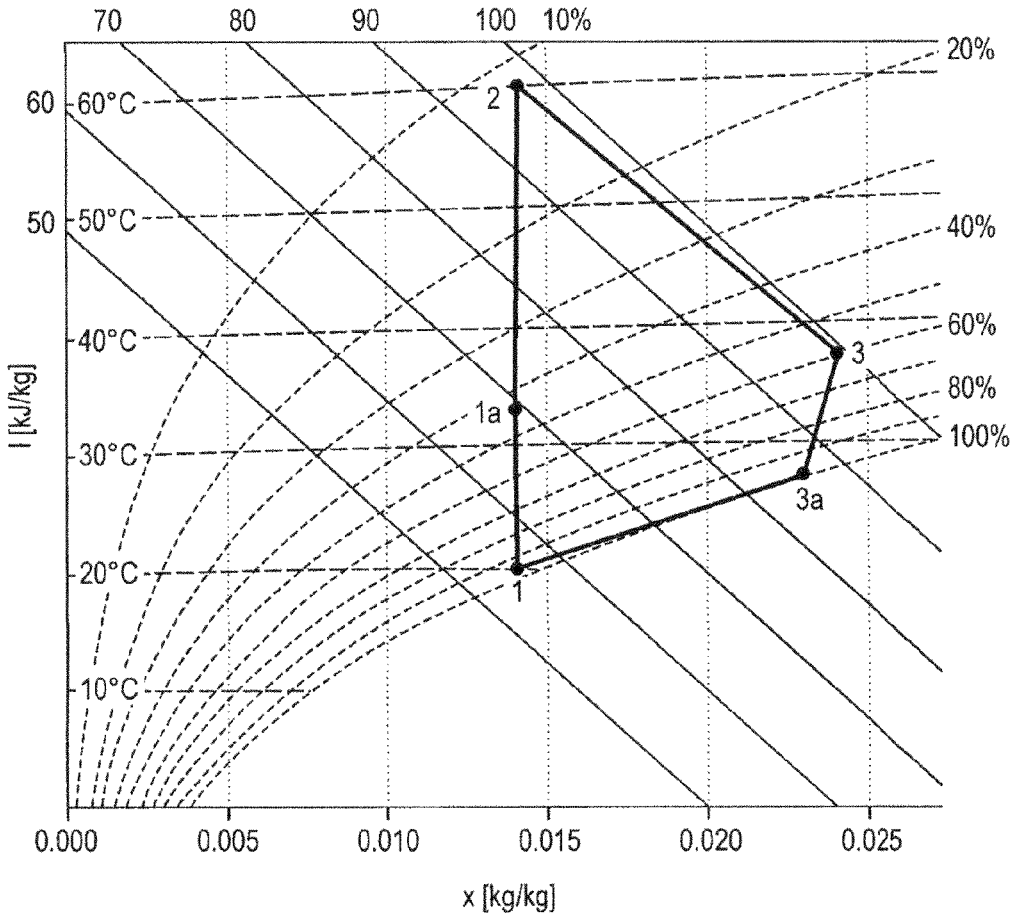
FIG. 4 is a Mollier (or I-, X-) diagram corresponding to modeling that was performed for a thermoelectric tumble dryer in accordance with an embodiment of the invention.

FIG. 4 is a Mollier (or I-, X-) diagram corresponding to modeling that was performed for a thermoelectric tumble dryer in accordance with an embodiment of the invention. Table 1, below, provides summary data corresponding to the diagram of FIG. 4. The diagram of FIG. 4 shows enthalpy (I) in kJ/kg of the air that is cycled through the drying process, on the vertical axis, versus water vapor content (x) in kg/kg of the air, on the horizontal axis. Numeral 1 of the cycle in FIG. 4 corresponds to conditions at point 314 of FIG. 3, where cold dry air is about to enter the internal heat exchanger 306 of FIG. 3. Numeral 1*a* of the cycle in FIG. 4 corresponds to conditions at point 318 of FIG. 3, where the dry air has been pre-warmed after passing through the internal heat exchanger 306. Numeral 2 of the cycle in FIG. 4 corresponds to conditions at point 311 of FIG. 3, where the dry air has been heated by the hot side of the thermoelectric module 300. Numeral 3 of the cycle in FIG. 4 corresponds to conditions at point 313 of FIG. 3, where warm moist air has emerged from the drum 312 having been passed through the enclosure containing the wet clothes. Numeral 3*a* of the cycle in FIG. 4 corresponds to conditions at point 315 of FIG. 3, where the warm air has been pre-cooled from having been passed through the internal heat exchanger 306, prior to entering the cold side of the thermoelectric module 300. From the conditions at numeral 3*a* of the cycle in FIG. 4, the air proceeds to be cooled by the cold side of the thermoelectric module 300, after which moisture is condensed at drain 317 (of FIG. 3) so that cold dry air is produced, returning to the cold dry air at numeral 1 of the cycle in FIG. 4, thereby closing the cycle. In Table 1, below, the numerals 1, 1*a*, 2, 3 and 3*a* correspond to the points of the cycle designated by numerals 1, 1*a*, 2, 3 and 3*a* in FIG. 4. The temperature (T), relative humidity (ϕ) in %, water vapor content (x) in kg/kg and enthalpy (I) in kJ/kg are listed for the points of the cycle of FIG. 4 corresponding to those numerals. Assuming an efficiency of $\eta_{IHX}$=0.82, the inlet temperature at the hot (313) and cold (314) side of the internal heat exchanger 306 (FIG. 3) were chosen to be 37° C. and 20° C., respectively, as shown by numerals 3 and 1 in Table 1, below:

TABLE 1

Conditions of the tumble drying process with thermoelectric heat pump and internal heat exchanger.

| | T [° C.] | ϕ [%] | x [kg/kg] | I [kJ/kg] |
|---|---|---|---|---|
| 1 | 20 | 94.11 | 0.0140 | 55.73 |
| 1a | 33 | 43.72 | 0.0140 | 69.20 |
| 2 | 60 | 11.04 | 0.0140 | 96.94 |
| 3 | 37 | 59.26 | 0.0241 | 99.17 |
| 3a | 27 | 100.00 | 0.0230 | 85.98 |

FIG. 4 depicts the process in a Mollier (or I-, x-) diagram, in which a constant proportion of latent and sensible heat is assumed, so that the heat transfers that occur can be illustrated as straight lines. The heat recovered in the internal heat exchanger 306 (FIG. 3) is visualized in FIG. 4 by the change in enthalpy between conditions 3 and 3*a* (corresponding to conditions at points 313 and 315 of FIG. 3) or between conditions 1*a* and 1 (corresponding to conditions at points 318 and 314 of FIG. 3). The required heating capacity of the thermoelectric heat pump is the distance from 1*a* to 2 in FIG. 4 (corresponding to conditions at points 318 and 311 in FIG. 3), and the required cooling capacity of the thermoelectric heat pump is the distance from 3*a* to 1 in FIG. 4 (corresponding to conditions at points 315 and 314 in FIG. 3). In addition to the thermodynamic cycle (of 1-1*a*-2-3-3*a*), curves of constant enthalpy, constant temperature and constant relative humidity are also shown in the diagram of FIG. 4.

It will be appreciated that in accordance with an embodiment of the invention, moist air may be cycled through the general thermodynamic cycle shown in the Mollier diagram of FIG. 4, without necessarily using the particular numbers or dimensions shown in FIG. 4, using a thermoelectric heat pump and internal heat exchanger.

Figure 5:
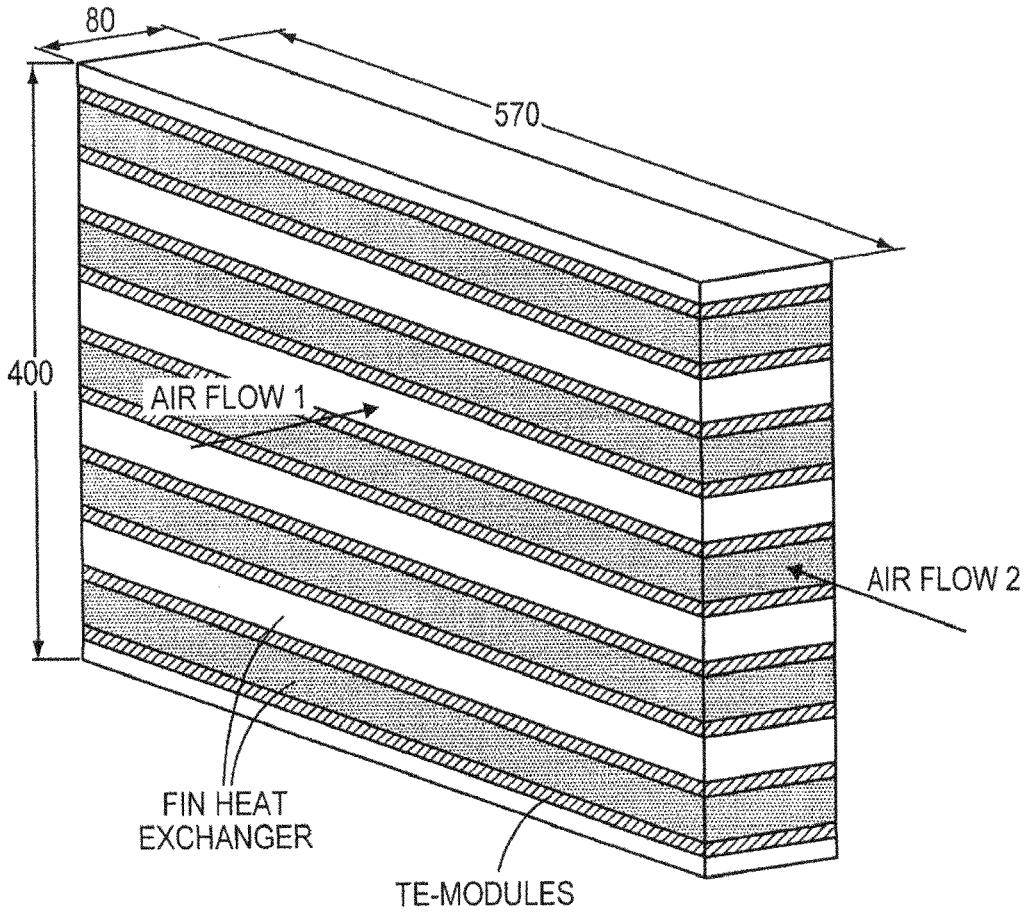
FIG. 5 is a diagram of dimensions of a thermoelectric heat pump used in simulation of a thermoelectric tumble dryer in accordance with an embodiment of the invention.

FIG. 5 is a diagram of dimensions of a thermoelectric heat pump used in simulation of a thermoelectric tumble dryer in accordance with an embodiment of the invention. In order to correspond to the usual dimensions of a domestic tumble dryer (length=595 mm, height=850 mm, depth=635 mm), the dimensions of the thermoelectric heat pump were chosen to allow smooth integration into an existing system. In FIG. 5, for example, the thermoelectric heat pump has exemplary dimensions of 570 mm by 400 mm by 80 mm. It will be appreciated that other dimensions may be used.

Table 2 shows the results of a simulation comparing a thermoelectric tumble dryer in accordance with an embodiment of the invention (TE1, TE2 and TE3) versus a conventional heat pump tumble dryer (HP 1, HP 2 and HP 3), in three different scenarios of operating conditions.

TABLE 2

Simulation results and comparison between conventional tumble dryer and thermoelectric system for different operating conditions.

| System | HP 1 | TE 1 | HP 2 | TE 2 | HP 3 | TE 3 |
|---|---|---|---|---|---|---|
| $m_{clothes}$ [kg] | 7.02 | | 8.01 | | 9.01 | |
| Δm [kg] | 4.7 | | 5.6 | | 6.3 | |
| Drying rate [$kg_{water}$/h] | 10.3 | | 11.3 | | 10.9 | |
| $\dot{Q}$ [kW] | 11.77 | 10.17 | 12.91 | 11.16 | 12.45 | 10.98 |
| $P_{el}$ [kW] | 2.24 | 2.88 | 2.24 | 3.16 | 2.57 | 3.11 |
| $P_{comp}$ [kW] | 0.40 | | 0.45 | | 0.52 | |
| COP [—] | 4.46 | 3.10 | 4.80 | 3.09 | 4.03 | 3.02 |
| SEC [kWh/$kg_{water}$] | 0.56 | 0.7 | 0.48 | 0.65 | 0.49 | 0.58 |

The relevant parameters mentioned in Table 2 are the amount of wet clothes ($m_{clothes}$, in kg), the mass of removed water (Δm, in kg), the drying rate ($kg_{water}$/h), the required heating capacity ($\dot{Q}$, in kW), the electrical power applied to the heat pump system ($P_{el}$ in kW), and the electrical power required to drive components such as the fan and the drum ($P_{comp}$, in kW). The efficiency of the systems are given by the coefficient of performance (COP), which is defined as the capacity over the total input energy:

$$COP = \frac{\dot{Q}}{P_{el} + P_{comp}}. \quad \text{(Equation 1)}$$

The specific energy consumption (SEC) is calculated as the total input power related to the obtained drying rate:

$$SEC = \frac{P_{el} + P_{comp}}{\dot{m}_{water}}. \quad \text{(Equation 2)}$$

Table 2 shows that the conventional heat pump system is still superior with regard to heating capacity and required power consumption and therefore achieves significantly higher values for the COP than the thermoelectric heat pump system. However, comparing the results for the SEC, it can be seen that the difference in the magnitudes is less prominent. Depending on the amount of wet clothes and the requested drying rate, the additional consumption of the thermoelectric system varies between 15% and 25%. Especially for operation conditions involving moderate drying rates and a large amount of wet clothes, which lead to a high energy consumption for the motor of the drum, the thermoelectric system is on a competitive basis with the conventional system.

Figure 6A:
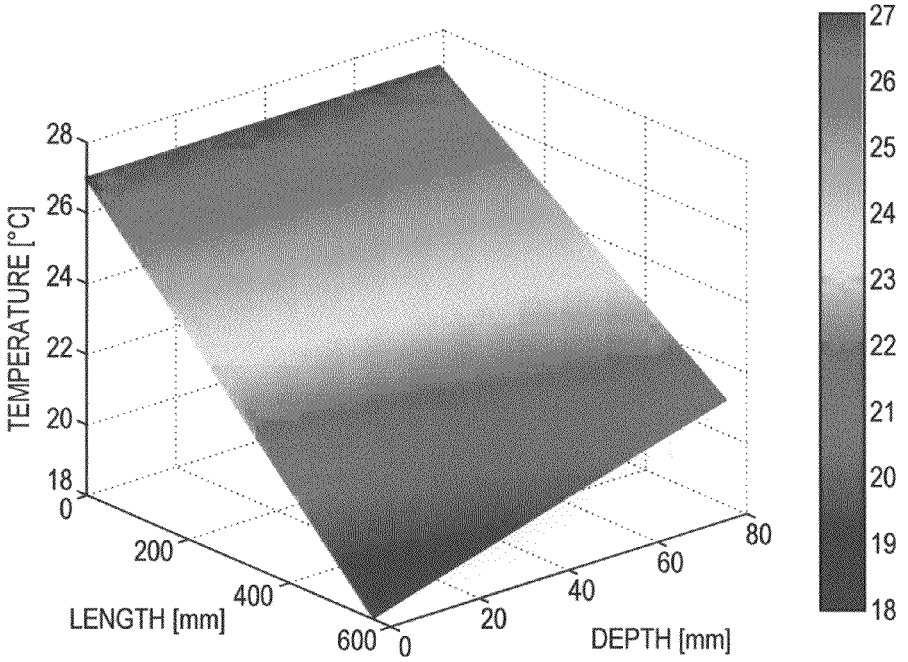
FIG. 6A shows a simulation of the temperature distribution for the air flow in a heat exchanger attached to the cold side of a thermoelectric module, in accordance with an embodiment of the invention.
Figure 6B:
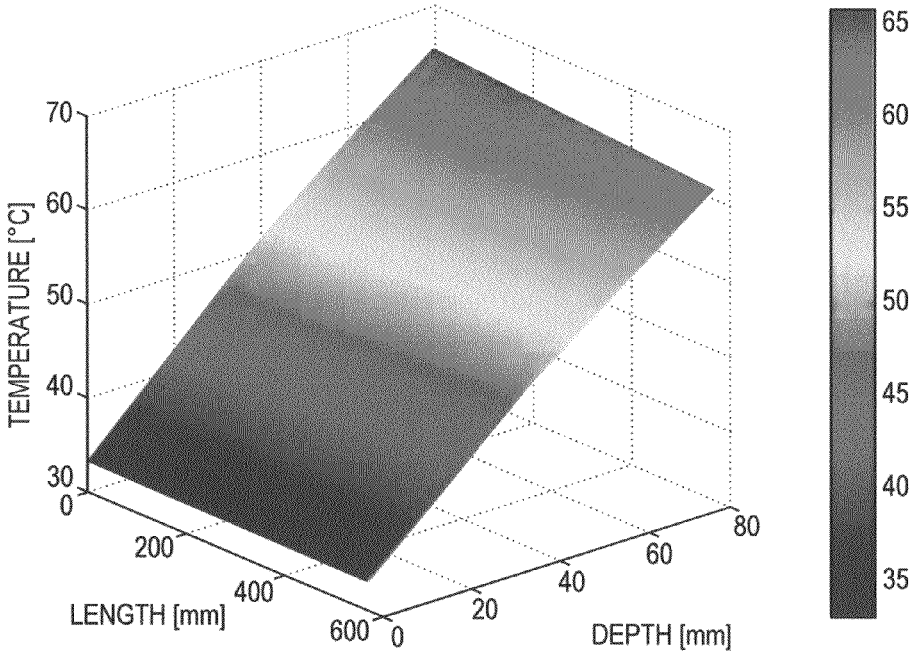
FIG. 6B shows a simulation of the temperature distribution for the air flow in a heat exchanger attached to the hot side of a thermoelectric module, in accordance with an embodiment of the invention.

FIGS. 6A and 6B show the results of a simulation of the temperature distribution over a fin heat exchanger corresponding to the dimensions for the thermoelectric module mentioned above in connection with FIG. 5, in accordance with an embodiment of the invention. FIG. 6A shows the temperature distribution for the air flow in the heat exchanger attached to the cold side of the thermoelectric module, and FIG. 6B shows the temperature distribution for the air flow in the heat exchanger attached to the hot side of the thermoelectric module. Due to the cross flow design of the thermoelectric heat pump in the simulation, the temperature distribution is not even, which means that the temperature distribution of the fluid flow at the outlet of the heat exchanger is dependent on the exit position. While the inlet condition for the cold side air flow is constant at 27° C., the outlet temperatures vary in the range of 18° C. to 21.1° C. and result in a mean temperature of 19.6° C. The outlet temperatures for the hot side air flow lie within 63.5° C. and 65.7° C., assuming an equal temperature distribution of 33° C. at the inlet of the heat exchanger. These results show that the thermoelectric heat pump system is capable of dealing with boundary conditions typically found in a drying process, and therefore represents an efficient alternative to conventional heat pumps in the application field of domestic tumble dryers.

Figure 7A:
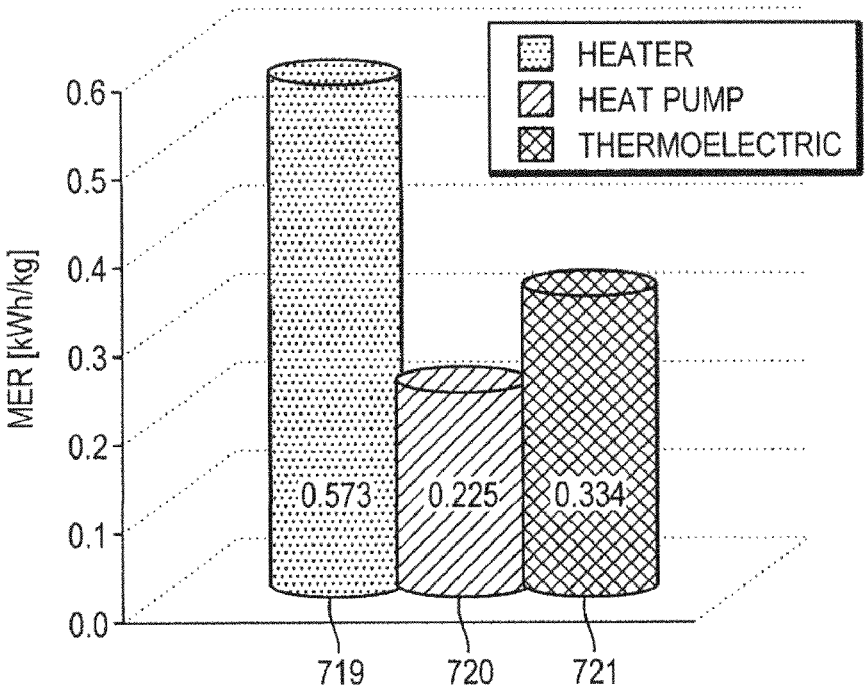
FIG. 7A is a chart comparing estimated efficiencies of domestic tumble dryer systems equipped with conventional electric resistance heaters, conventional compression heat pumps and a thermoelectric heat pump without use of an internal heat exchanger.
Figure 7B:
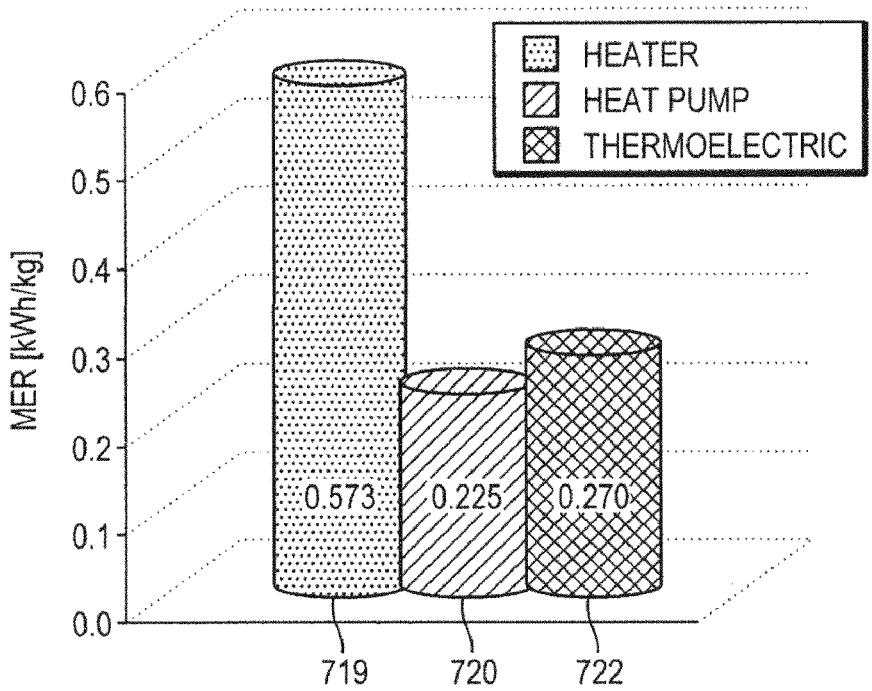
FIG. 7B is a chart comparing estimated efficiencies of domestic tumble dryer systems equipped with conventional electric resistance heaters, conventional compression heat pumps and a thermoelectric heat pump with an internal heat exchanger according to an embodiment of the invention.

FIGS. 7A and 7B are charts comparing estimated efficiencies of domestic tumble dryer systems equipped with conventional electric resistance heaters, conventional compression heat pumps, a thermoelectric heat pump without use of an internal heat exchanger, and a thermoelectric heat pump with an internal heat exchanger in the drying process according to an embodiment of the invention. FIGS. 7A and 7B show that tumble dryers equipped with thermoelectric heat pumps are an efficient alternative to conventional systems, especially when used in combination with an internal heat exchanger.

FIG. 7A is a comparison of the estimated Moisture Extraction Rate (MER) for three different tumble dryer systems: system 719 using an electric resistance heater, system 720 using a conventional heat pump and system 721 using a thermoelectric heat pump without using an internal heat exchanger. The Moisture Extraction Rate is here defined as the electric power input required per mass of wet clothes, in kilowatt hours per kilogram, i.e., $$MER = \frac{P_{el}}{m_{clothes}} \qquad \text{Equation (3)}$$

As can be seen in FIG. 7A, the conventional electric resistance heater system 719 has a much higher rate of energy use per load of wet clothes (at 0.573 kWh/kg) as compared with the conventional compression heat pump system 720 (at 0.225 kWh/kg) and thermoelectric heat pump system 721 (at 0.334 kWh/kg). The increased efficiency of a system using a thermoelectric heat pump as compared with one using an electric resistance heater can be seen to follow from a consideration of the power input to each. Specifically, an electric resistance heater has a heating capacity $\dot{Q}_{hot}$ that is at best equal to the power input $P_{el}$ given by:

$$\dot{Q}_{hot,max}=P_{el}=R\cdot I^2 \qquad \text{Equation (4)}$$

where I is the current flowing through the resistance heater and R is its resistance. By contrast, in a thermoelectric heat pump, $$\dot{Q}_{hot}=P_{el}+\dot{Q}_{cold} \qquad \text{Equation (5)}$$

where $\dot{Q}_{hot}$ is the heating capacity, $P_{el}$ is the electric power input, and $\dot{Q}_{cold}$ is the cooling capacity for the thermoelectric heat pump. It follows from Equations (4) and (5) that a system using a thermoelectric heat pump has a higher heating capacity for a given electric power input than a system using an electric resistance heater.

FIG. 7B is a comparison of the estimated moisture extraction rate of a thermoelectric heat pump system 722 in accordance with an embodiment of the invention versus the conventional electric resistance heater system 719 and conventional heat pump system 720. At an MER of 0.270 kWh/kg, the thermoelectric heat pump system 722 in accordance with an embodiment of the invention is much more efficient than a conventional electric resistance heater system 719 and is comparable in efficiency to a conventional heat pump system 720. However, unlike the conventional heat pump system 720, the system 722 has no moving parts other than the moving drum, with consequent advantages in reliability and quietness of operation, and uses no potentially environmentally harmful refrigerants. Improvements in efficiency of the thermoelectric module and internal heat exchanger may allow the efficiency of the system in accordance with an embodiment of the invention to be improved. Further, the system 722 in accordance with an embodiment of the invention is estimated to be competitive in cost to a conventional compression heat pump system. These improvements promise a highly attractive, environmentally friendly, and commercially viable product.

Although embodiments have been described herein as being useful for a tumble dryer, it will be appreciated that embodiments may be useful in other applications involving drying, heating or cooling. For example, drum 312 (see FIG. 3) may be replaced with a drying enclosure, heating enclosure or cooling enclosure in which an object or fluid is dried, heated or cooled. Further, it will be appreciated that objects or fluids to be dried, heated or cooled need not be contained within an enclosure, but could also be in direct or indirect heat exchange relationship with a heat exchanger that takes the place of drum 312. It will be appreciated that various changes in the circuit shown in FIG. 3 may be made to achieve drying, heating or cooling. Further, the thermal cycles of FIG. 3 and FIG. 4, and use of a thermoelectric heat pump and internal heat exchanger in such a cycle, may be applied generally in fields other than tumble drying. A blower or other components may be added to improve circulation of air through the circuit. In addition, embodiments may be used with liquids and gases other than wafer and air.

In accordance with an embodiment of the invention, a thermal cycle may use a thermoelectric module and an internal heat exchanger for heating or cooling, without necessarily drying a space or the objects in it to a great degree, and without necessarily condensing liquid in the process. For example, a heating or cooling embodiment may be used in heating or cooling for at least a part of a building or in heating or cooling of a vehicle passenger compartment. When the system is used for heating and cooling for a building or a vehicle's passenger compartment, the amount of condensation occurring in the system depends on the operation conditions and the humidity of the gas flow, and may be relatively little or essentially none. In such applications, a closed cycle system need not be used, and the system may be an open cycle system (i.e., open to the surrounding environment), unlike the system of the embodiment of FIG. 3. Two different gas flows, one that is heated and one that is cooled, may interact in the internal heat exchanger in such an embodiment. A gas may exchange heat through an internal heat exchanger with another fluid, which may be the gas itself, another gas, or may, for example, be a liquid such as water. A heating or cooling embodiment may be useful, for example, for heating or cooling a passenger compartment of a hybrid vehicle.

While this invention has been particularly shown and described with references to example embodiments thereof, it will be understood by those skilled in the art that various changes in form and details may be made therein without departing from the scope of the invention encompassed by the appended claims.

What is claimed is:

1. A method for using a closed thermal cycle to remove a liquid from at least one object comprising moisture, the method comprising:

flowing a hot and dry gas, having flowed through a thermoelectric module, over the at least one object thereby producing moist gas at an intermediate temperature;

flowing the moist gas at the intermediate temperature through an internal heat exchanger, the moist gas at the intermediate temperature being in heat exchange relationship with cold dry gas flowing through the internal heat exchanger, thereby producing cooled moist gas;

flowing the cooled moist gas exiting the internal heat exchanger through a first heat exchanger in heat exchange relationship with a cold side of the thermoelectric module, thereby condensing the liquid in the moist gas and producing cold dry gas;

flowing the cold dry gas exiting the first heat exchanger through the internal heat exchanger in heat exchange relationship with the moist gas at the intermediate temperature, thereby pre-warming the cold dry gas; and flowing the pre-warmed dry gas through a second heat exchanger in heat exchange relationship with a hot side of the thermoelectric module, thereby closing the cycle by producing the hot dry gas flowed over the at least one object.

2. The method of claim 1, wherein flowing the hot and dry gas over the at least one object comprises flowing the hot and dry gas into an enclosure containing the object.

3. The method of claim 2, wherein the gas comprises air and the liquid comprises water.

4. The method of claim 3, wherein the enclosure comprises a drum of a tumble dryer.

5. The method of claim 4, wherein at least one of the first heat exchanger, second heat exchanger and internal heat exchanger comprises a fin heat exchanger.

6. The method of claim 4, wherein at least one of the first heat exchanger, second heat exchanger and internal heat exchanger is selected from the group consisting of a shell and tube heat exchanger, a tube in tube heat exchanger, a twisted tube heat exchanger and a plate type heat exchanger.

7. The method of claim 4, wherein the thermoelectric module comprises p- and n-doped semiconductor materials.

8. The method of claim 4, wherein the liquid is removed from the object without use of a compression heat pump or electrical resistance heater.

9. The method of claim 1, wherein the internal heat exchanger exchanges heat in at least one of a cross flow, counter flow, or concurrent flow configuration.

10. The method of claim 1, wherein the first heat exchanger and second heat exchanger are arranged in at least one of a cross flow, counter flow, or concurrent flow configuration.

11. The method of claim 1, wherein the first heat exchanger and second heat exchanger are parts of a single heat exchanger that comprises the first heat exchanger and the second heat exchanger.

12. A system for using a closed thermal cycle to remove a liquid from at least one object comprising moisture, the system comprising:

a thermoelectric module flowing a gas, thereby producing hot and dry gas;

an enclosure containing the at least one object and arranged to receive the hot and dry gas for flow over the at least one object and thereby to produce a flow of moist gas at an intermediate temperature;

an internal heat exchanger arranged to exchange heat between the flow of the moist gas at the intermediate temperature and a flow of cold dry gas, thereby producing cooled moist gas and pre-warmed dry gas; and the thermoelectric module comprising a first heat exchanger in heat exchange relationship with a cold side of the thermoelectric module and a second heat exchanger in heat exchange relationship with a hot side of the thermoelectric module, the first heat exchanger being arranged to flow the cooled moist gas in heat exchange relationship with the cold side of the thermoelectric module thereby condensing the liquid in the cooled moist gas and producing cold dry gas, the cold dry gas being arranged to be flowed through the internal heat exchanger thereby producing the pre-warmed dry gas, and the second heat exchanger being arranged to flow the pre-warmed dry gas in heat exchange relationship with the hot side of the thermoelectric module, thereby closing the cycle by producing the hot dry gas arranged to be received by the enclosure.

13. The system of claim 12, wherein the gas comprises air and the liquid comprises water.

14. The system of claim 12, wherein the enclosure comprises a drum of a tumble dryer.

15. The system of claim 14, wherein at least one of the first heat exchanger, second heat exchanger and internal heat exchanger comprises a fin heat exchanger.

16. The system of claim 14, wherein at least one of the first heat exchanger, second heat exchanger and internal heat exchanger is selected from the group consisting of a shell and tube heat exchanger, a tube in tube heat exchanger, a twisted tube heat exchanger and a plate type heat exchanger.

17. The system of claim 14, wherein the thermoelectric module comprises p- and n-doped semiconductor materials.

18. The system of claim 14, wherein the system does not comprise a compression heat pump or electrical resistance heater.

19. The system of claim 12, wherein the internal heat exchanger is arranged to exchange heat in at least one of a cross flow, counter flow, or concurrent flow configuration.

20. The system of claim 12, wherein the first heat exchanger and second heat exchanger are arranged in at least one of a cross flow, counter flow, or concurrent flow configuration.

21. The system of claim 12, wherein the first heat exchanger and second heat exchanger are parts of a single heat exchanger that comprises the first heat exchanger and the second heat exchanger.

22. A system for using a closed cycle to remove a liquid from at least one object comprising moisture, the system for removing the liquid comprising:

an enclosure means containing the at least one object and being for receiving a hot and dry gas for flow over the at least one object and thereby producing a flow of moist gas at an intermediate temperature;

an internal heat exchanger means for exchanging heat between the flow of the moist gas at the intermediate temperature and a flow of cold dry gas, thereby producing cooled moist gas and pre-warmed dry gas; and a thermoelectric module means comprising a first heat exchanger means in heat exchange relationship with a cold side of the thermoelectric module means and a second heat exchanger means in heat exchange relationship with a hot side of the thermoelectric module means, the first heat exchanger means being for flowing the cooled moist gas in heat exchange relationship with the cold side of the thermoelectric module means thereby condensing the liquid in the cooled moist gas and producing cold dry gas, the cold dry gas being arranged to be flowed through the internal heat exchanger means thereby producing the pre-warmed dry gas, and the second heat exchanger means being for flowing the pre-warmed dry gas in heat exchange relationship with the hot side of the thermoelectric module means, thereby closing the cycle by producing the hot dry gas for receiving by the enclosure.

* * * * *